US005538663A

United States Patent [19]

Kihara et al.

[11] Patent Number: 5,538,663

[45] Date of Patent: Jul. 23, 1996

[54] DETERGENT COMPOSITION

[75] Inventors: Hideki Kihara, Sakura; Yasushi Kajihara, Kasukabe; Hajime Hirota, Tokyo, all of Japan

[73] Assignee: Kao Corporation, Tokyo, Japan

[21] Appl. No.: 831,740

[22] Filed: Feb. 10, 1992

Related U.S. Application Data

[63] Continuation of Ser. No. 437,667, Nov. 17, 1989, abandoned.

[30] Foreign Application Priority Data

Dec. 2, 1988 [JP] Japan ..... 63-305595

[51] Int. Cl.[6] ..... C11D 3/14; C11D 3/37

[52] U.S. Cl. ..... 510/395; 510/396; 510/397; 510/398; 510/113; 510/119; 510/131; 510/137; 510/139; 510/236; 510/384; 510/389; 510/391

[58] Field of Search ..... 252/174.23, 174.25, 252/DIG. 2, 129, 130, 106, 174.24

[56] References Cited

U.S. PATENT DOCUMENTS

| | | | |
|---|---|---|---|
| 3,645,904 | 2/1972 | Beach | 252/120 |
| 3,708,435 | 1/1973 | Starkman | 252/544 |
| 3,819,525 | 6/1974 | Hattenbrun | 252/132 |
| 4,048,123 | 9/1977 | Hramchenko et al. | 252/545 |
| 4,155,870 | 5/1979 | Jorgensen | 252/131 |
| 4,508,634 | 5/1985 | Elepano et al. | 252/163 |
| 4,557,853 | 12/1985 | Collins | 252/128 |
| 4,655,957 | 4/1987 | Chromecek et al. | 252/174.23 |
| 4,673,526 | 6/1987 | Zabotto et al. | 252/174.16 |
| 4,772,425 | 9/1988 | Chirash et al. | 252/174.25 |
| 4,786,432 | 11/1988 | Kanfer et al. | 252/120 |

FOREIGN PATENT DOCUMENTS

| | | |
|---|---|---|
| 0063472 | 10/1982 | European Pat. Off. . |
| 0100194 | 2/1984 | European Pat. Off. . |
| 2563104 | 10/1985 | France . |
| 58-192814 | 11/1983 | Japan . |
| 2158839 | 11/1985 | United Kingdom . |

OTHER PUBLICATIONS

*Chemical Abstracts*, vol. 100(6), 1984, No. 100:39461j (no month available).

*Chemical Abstracts*, vol. 96(24), 1982, No. 96:205221b (no month available).

*Primary Examiner*—Erin M. Harriman

*Attorney, Agent, or Firm*—Oblon, Spivak, McClelland, Maier & Neustadt

[57] ABSTRACT

A detergent composition is disclosed. The composition comprises polymer particles having an average particle size of 50–500 μm in 5% by weight sodium chloride aqueous solution and a modulus of elasticity of $1\times10^3$–$5\times10^5$ dyne/cm$^2$ in said sodium chloride aqueous solution. It exhibits a superior physical or mechanical washing performance, and gives remarkably reduced irritation and minimal damage to the object being washed. When a germicide is incorporated in addition to the polymer particles, its sterilization effect is greatly enhanced.

9 Claims, No Drawings

DETERGENT COMPOSITION

This application is a Continuation of application Ser. No. 07/437,667, filed on Nov. 17, 1989, now abandoned.

BACKGROUND OF THE INVENTION

1. Field of the Invention

The present invention relates to a detergent composition, and, more particularly, to a detergent composition comprising a specific type of polymer particle, which exhibits a superior physical or mechanical washing performance, and gives a remarkably reduced irritation and minimal damage to the object being washed.

2. Description of the Background Art

There are detergent compositions which comprise particles with an object of promoting mechanical washing performances. Some examples known in the art are as follows:

(1) A detergent composition containing 1–15% by weight of polymer particles having a particle size of 50 μm or smaller and an internal surface area of 100 $m^2/g$ or greater. The polymers include those from divinylbenzene, styrene, or alkyl styrene, and a mixture of two or more of these polymers. A 20% or less amount of polymers prepared from acrylic acid and/or methacrylic acid derivatives may optionally be used in combination. (German Democratic Republic Patent No. 209733)

(2) A detergent composition for washing contact lens, the face, or hands which contains 0.001–25% by weight of polymer particles having a size of 0.1–10 μm. Polymers may be selected from hydrophillic cross-linked vinyl polymer, and polymers of polyhydroxy methacrylic acid, acrylic acid, or poly(N-vinyllactam). (U.S. Pat. No. 4,655,957)

(3) A scrub skin cleanser containing 2.5–20% by weight of pearl powder or chips having a size of 100–500 μm. (Japanese Patent Laid-open No. 13152/1981)

Among the above detergent compositions, the composition (1) has hard particles which are irritative to the skin. Too small particle sizes of this composition do not give a good detergent efficiency. The detergent composition (2) comprises polymer particles of which the average diameter is very small. This composition imparts very low irritation. Its mechanical washing performance is, however, not sufficient. In contrast, the detergent composition (3) exhibits high detergency, but imparts harsh irritation to the skin. This is because particles contained in this composition are hard and not regular in shape. They have the risk of damaging the skin surface and thus are not suitable for use as a component of detergents for washing skin.

As can be seen in these detergent compositions, conventional techniques could not satisfy the detergency and non-irritation at the same time. The one can only be satisfied at the sacrifice of the other. This has been the problem which has needed to be solved in conventional detergent compositions.

In view of this situation, the present inventors have conducted extensive studies concerning the relationship between the characteristics of polymer particles and their detergency. As a result, the inventors have found that detergent compositions comprising polymer particles having a suitable modulus of elasticity and a specific particle size could surprisingly exhibit superior detergency without imparting irritation and damage to the object to be washed, and that, if a germicide is incorporated in addition to such polymer particles, sterilization effects on the object to be washed by the detergent composition were greatly enhanced.

SUMMARY OF THE INVENTION

Accordingly, an object of the present invention is to provide a detergent composition comprising polymer particles having an average particle size of 50–500 μm in 5% by weight sodium chloride aqueous solution and a modulus of elasticity of $1\times10^3$–$5\times10^5$ dyne/$cm^2$ in said aqueous solution.

Another object of the present invention is to provide a detergent composition further comprising a germicide.

Other objects, features and advantages of the invention will hereinafter become more readily apparent from the following description.

DETAILED DESCRIPTION OF THE INVENTION AND PREFERRED EMBODIMENTS

Any polymer particles can be used in the detergent composition of the present invention so long as the same has a modulus of elasticity of $1\times10^3$–$5\times10^5$ dyne/$cm^2$ in a 5% by weight (hereinafter described simply as "%") sodium chloride aqueous solution. A particularly desirable modulus of elasticity range is $1\times10^4$–$1\times10^5$ dyne/$cm^2$. If the modulus of elasticity is smaller than $1\times10^3$ dyne/$cm^2$, the detergent capacity is not sufficient. On the other hand, if greater than $5\times10^5$ dyne/$cm^2$, the detergent composition has the risk of damaging the object to be washed. Here, the modulus of elasticity of polymer particles is measured by the following method. A single layer of polymer particles immersed in 5% sodium chloride aqueous solution for at least one hour is placed on an aluminum sample pan, and the pan is placed in a thermal stress measuring device (TMA/SS10, manufactured by Seiko Electronic Co., Ltd.). A load of 3 g is put onto the sample in advance at room temperature by a cylindrical expansion-compression sample holder probe made of quartz and having a 0.71 $mm^2$ cross-sectional area. A sine curve stress of 1 g amplitude and 0.005 Hz cycle is charged. The modulus of elasticity is then determined from the strain produced.

The polymer particles of the present invention have an average particle size of 50–500 μm, preferably of 100–300 μm, in 5% sodium chloride aqueous solution. If the average particle size is smaller than 50 μm, the detergency of the composition is not sufficient. If greater than 500 μm, inconsistency and irritation to the skin result. Particle sizes are measured in this invention by optical microscopic photography at a 50–100 magnification. Polymer particles which have been expanded in 5% sodium chloride aqueous solution for 1 hour are placed on a glass slide having a recess in the center, and the slide is covered with a cover slide. An optical microscopic photograph is then taken through the cover slide.

There are no specific limitations as to the shapes of the particles. Polymers obtained by block polymerization can be used after pulverization to the specified particle size. Desirable shapes of the particles are spherical or oval.

Either hydrophillic or hydrophobic polymers can be used as the material for the polymer particles. Mixtures of hydrophillic and hydrophobic polymers may also be used.

Examples of hydrophillic polymers include hydrated gels derived from carrageenan, gelatin, agar, tragacanth gum, viscose, methylcellulose, ethylcellulose, hydroxyethylcellulose, carboxymethylcellulose, polyvinyl alcohol, or the like, and stabilized by the addition of polyvalent metal salts; cross-linked homopolymers or copolymers of two or more monomers such as acrylic acid or methacrylic acid (hereinafter collectively referred to as (meth)acrylic acid), (meth-)acrylic acid salts of sodium, ammonium, or the like, N-substituted (meth)acrylic amides, 2-(meth)acryloylethanesulfonic acid or salts thereof, styrenesulfonic acid or salts thereof, 2-hydroxyethyl(meth)acrylate, N-vinylpyrrolidone, vinylmethyl ether, polyethylene oxide (meth)acrylic acid ester, and the like; cross-linked polymers of saponified vinyl acetate-methyl acrylate copolymer, saponified vinyl acetate-monomethyl maleate copolymer, saponified isobutylene-maleic anhydride copolymer, and the like; hydrolyzates of starch-acrylic acid graft polymer, polysaccharide-acrylic acid graft polymer, starch-acrylonitrile graft polymer, and the like.

An example of producing cross-linked polymers having a suitable modulus of elasticity is to polymerize a monomer or a mixture of monomers and a cross-linking agent such as polyfunctional vinyl monomer or other monomers having at least two functional groups other than vinyl group, e.g. epoxy group, by a conventional method. Another method is first to produce a homopolymer or copolymer and then to react a cross-linking agent with the homopolymer or copolymer. Examples of polyfunctional vinyl monomers are N,N'-methylene-bis(acrylamide), ethylene glycol dimethacrylate, polyethylene glycol diacrylate, polyethylene glycol dimethacrylate, trimethylolpropane triacrylate, and the like. Cross-linking agents having at least two functional groups other than vinyl group include, for example, glycidyl ether-, diisocyanate-, and dimaleimide-type compounds. Of these, given as examples of glycidyl ether-type compounds are ethylene glycol diglycidyl ether, polyethylene diglycol diglycidyl ether, glycerol diglycidyl ether, glycerol triglycidyl ether, triglycidyl isocyanate, and the like; as examples of diisocyanate-type compounds are methylene-bis(4-phenylisocyanate), 2,6-trilenediphenyldiisocyanate, isophoronediisocyanate, hexamethylenediisocyanate, xylilenediisocyanate, and the like; and as examples of dimaleimide-type compounds are N,N'-1,4-phenylenediamine dimaleimide, N,N'-1,2-phenylenediamine dimaleimide, N,N'-hexamethylenediamine dimaleimide, N,N'-tetramethylenediamine dimaleimide, and the like. Copolymers of the above hydrophillic monomer and a hydrophobic monomer, such as styrene, (meth)acrylic acid ester, may also be used inasmuch as the characteristics of the produced polymers, such as modulus elasticity and the like, are not excessively impaired. From the aspect of obtaining a better expansion ratio, preferable polymers are those produced from one or more hydrophillic monomers.

Among these hydrophillic polymers, those having a expansion ratio in 5% sodium chloride aqueous solution of 1.2–5 times are preferable. Here, the expansion ratio is expressed by the ratio of the expanded polymer particle diameter for the dry polymer particle diameter.

Given as examples of hydrophobic polymers are polymers obtained by a known suspension polymerization, using or without using an organic solvent, of (i) a monovinyl monomer which can produce a homopolymer having a glass transition temperature below 25° C., such as alkyl (meth-)acrylate, substituted alkyl (meth)acrylate, fatty acid vinyl ester, or the like, (ii) a mixture of two or more of the above monovinyl monomers (i), or (iii) a mixture of the above monovinyl monomers (i), other monovinyl monomers which are mentioned below as group A monovinyl monomers, and polyfunctional vinyl monomers.

Here given as examples of alkyl acrylates are methyl acrylate, ethyl acrylate, propyl acrylate, butyl acrylate, 2-ethylhexyl acrylate, dodecyl acrylate, tetradecyl acrylate, hexadecyl acrylate, and the like; as examples of substituted alkyl acrylates are 2-ethoxyethyl acrylate, 2-cyanoethyl acrylate, benzyl acrylate, and the like; as examples of alkyl (meth)acrylates are butyl (meth)acrylate, 2-ethylhexyl (meth)acrylate, decyl (meth)acrylate, dodecyl (meth)acrylate, hexadecyl (meth)acrylate, and the like; and as examples of fatty acid vinyl esters are vinyl acetate, vinyl propionate, vinyl cyclohexylacetate, and the like.

The group A monovinyl monomers include styrene and its derivatives such as p-methylstyrene, p-chlorostyrene, and the like; (meth)acrylic acid esters which can produce a homopolymer having a glass transition temperature above 25° C., such as methyl (meth)acrylate, ethyl (meth)acrylate, propyl (meth)acrylate, t-butyl (meth)acrylate, and the like; acrylonitrile, methacrylonitrile, vinyl chloride, and the like. These group A monovinyl monomers can be added in an amount not impairing the characteristics of the resulting polymers, such as the modulus of elasticity.

Examples of polyfunctional vinyl monomers include divinylbenzene, trivinylbenzene, ethylene glycol dimethacrylate, ethylene glycol diacrylate, trimethylolpropane triacrylate, and the like.

Lipophillic polymers used in this invention also include reactive copolymers obtained from (a) the above-mentioned monovinyl monomers or a mixture of such monovinyl monomers and the above group A monovinyl monomers, in which the latter monomers are included in an amount not impairing the characteristics of the resulting polymers, and (b) one type of monomer having a functional group such as an epoxy group (e.g. glycidyl methacrylate, etc.), carboxyl group (e.g. acrylic acid, methacrylic acid, etc.), or the like. Such reactive copolymers are used after cross-linking by a conventional method.

In addition, ethylene rubber (EPM), propylene rubber (EPDM), natural rubber, styrene butadiene rubber (SBR), butadiene rubber (BR), silicone rubber, and the like can be used as a hydrophobic polymer.

Sodium or ammonium salt of (meth)acrylic acid from among the above hydrophillic polymers and polymers containing acrylic acid ester from among the above hydrophobic polymers are preferable from the aspect of availability of the raw materials and ready control of the modulus of elasticity. Particularly preferable polymers for ensuring a desired modulus of elasticity are those containing at least 50% of (meth)acrylic acid salts or (meth)acrylic acid esters.

It is desirable that polymer particles be incorporated into the detergent composition of the present invention in an amount of 0.1–30% by weight, and particularly 1–10% by weight.

The methods of preparation of phydrophyllic or hydrophobic polymers are not restricted to those described above. An appropriate polymerization method can be selected from conventionally known block polymerization, suspension polymerization, reversed-phase suspension polymerization, and solution polymerization methods. Polymer particles produced can be used either as are or after adjusting the particle size by pulverization and screening.

There are no specific limitations as to the types of surface active agents used in the detergent composition of the present invention. Examples include anionic surface active agents such as fatty acid soaps, phosphates, acylated amino acids, sulfo-succinic acids, taurates, and the like; nonionic surface active agents such as alkyl saccharides, ethylene oxide addition compounds, and the like. Among these, phosphates, acylated amino acids, and alkyl saccharides are preferable because of their low irritation to the skin.

There are no specific limitations as to the amount of the major surface active agents to be incorporated into the detergent composition. When the detergent composition is a solid-type the preferable amount is 60–90%. For paste type and gel type detergent compositions the preferable amount is 40–70%, and for a liquid type 10–50%.

Beside the above major surface active agents, amine oxide or imidazoline-type surface active agents are preferably incorporated for the purpose of promoting foaming capability.

When a germicide is used together with the detergent composition, the mechanical washing capability provided by polymer particles enhances its germicidal effect even more, and even a small amount of germicide addition results in a sufficient sterilization effect. Given as examples of germicides are quaternary ammonium salts, polyhexamethylene biguanide, chlorohexidine gluconate, iodoform, 3,4,4'-trichlorocarbanilide, 2,4,4'-trichloro-2'-hydroxydiphenyl ether, and the like. Germicides that can be used are, of course, not limited to those given here.

Beside the components discussed above, other components which are commonly used for detergent compositions can be added to the detergent composition of the present invention to the extent that such an addition does not affect the effect of the composition. They are, for example, viscosity increasing agents, moisturizing agents, coloring agents, antiseptics, feeling improvers, perfumes, antiphlogistics, UV absorbers, and the like.

The detergent composition of the present invention has a wide variety of applications, including, for example, skin-washing detergents (e.g. face cleansers, body cleansers, solid soaps, etc.), shampoos, kitchen detergents, contact lens cleaners, and the like.

The detergent composition of the present invention imparts no or extremely low irritation and small damage to the surface of the object to be washed such as the skin and scalp, and also gives an excellent feeling during washing. In addition, the detergent composition to which a germicide is added exhibits remarkably improved germicidal or sterilizing effects.

Other features of the invention will become apparent in the course of the following description of the exemplary embodiments which are given for illustration of the invention and are not intended to be limiting thereof.

EXAMPLES

Synthetic Example 1

510 g of 80% acrylic acid aqueous solution was neutralized with 360 g of 30% sodium hydroxide aqueous solution at a temperature below 35° C. To the solution were added and dissolved 0.9 g of potassium persulfate and 12.2 g of ethylene glycol diglycidyl ether (3.0% based on acrylic acid). The aqueous solution of monomers thus prepared was added dropwise to a solution of 5.0 g of ethylcellulose in 1,600 ml of cyclohexane maintained at 75° C. over 1.5 hours under a nitrogen atmosphere while stirring. After the completion of the addition, the stirring was continued for a further 10 hours at a temperature of 70°–75° C. to complete the polymerization reaction. The amount of water in the produced polymer which was suspended in cyclohexane was adjusted to 25% by azeotropic dehydration while refluxing cyclohexane. Cyclohexane was removed by distillation at 80°–100° C. under reduced pressure to produce dried bead-like sodium polyacrylate having an average particle size of 200 μm (size distribution 100–250 μm) and a modulus of elasticity of $6.0\times10^4$ dyne/cm$^2$.

Synthetic Example 2

A mixture of 100 g of 2-ethylhexyl acrylate, 0.5 g of ethylene glycol dimethacrylate, and 1.0 g of peroxy lauroyl, and a solution of 2.33 g of polyvinyl alcohol (Gosenol GH-17, manufactured by Nippon Synthetic Chemical Industry Co., Ltd.) in 230.7 g of ion-exchanged water were charged into a 1 l four-necked flask, and stirred at 350 rpm until dispersion. The temperature was raised to 80° C., at which the reaction proceeded for 8 hours. The cross-linked polymer suspension thus prepared was subjected to steam distillation to produce beads of cross-linked 2-ethylhexyl polyacrylate having an average particle size of 150 μm and a modulus of elasticity of $3.8\times10^4$ dyne/cm$^2$.

EXAMPLE 1

The modulus of elasticities and detergent capacities of polymer beads of sodium polyacrylate prepared in Synthetic Example 1, 2-ethylhexyl polyacrylate prepared in Synthetic Example 2, and, for comparison, polystyrene (Finepearl PB-3012, manufactured by Sumitomo Chemical Co., Ltd.) were measured according to the following methods.

Measurement of Modulus of Elasticity

A single layer of polymer particles immersed in 5% sodium chloride aqueous solution for at least one hour was placed on an aluminum sample pan, and the pan was placed in a thermal stress measuring device (TMA/SS10, manufactured by Seiko Electronic Co., Ltd.). A load of 3 g was put onto the sample in advance at room temperature by a cylindrical expansion-compression sample holder probe made of quartz and having a 0.71 mm$^2$ cross-sectional area. A sine curve stress of 1 g amplitude and 0.005 Hz cycle was charged. The modulus of elasticity was then determined from the strain produced.

Measurement of Detergency

A solid fat dyed with 1-[(p-phenylazo)-phenyl]azo[2-naphthol] was applied to dried pig skin over a circular area having a 15 mm diameter at a 0.1 mm thickness, The fat was washed with a 5% sodium chloride aqueous solution containing polymer beads. The remaining solid fat was dissolved in an organic solvent and the absorbance of the solution was measured. The detergency was determined as the percentage of the measured absorbance for the absorbance measured on the solution of unwashed solid fat.

The results are shown in Table 1.

TABLE 1

| Polymer Particles | Average Diameter (μm) | Modulus of Elasticity (dyne/cm$^2$) | Detergency (%) |
|---|---|---|---|
| Example 1 | 200 | $6.0\times10^4$ | 69 |
| Example 2 | 150 | $3.8\times10^4$ | 65 |
| Polystyrene | 200 | $2.0\times10^6$ | 77 |

EXAMPLE 2

Sample detergent compositions were prepared by using the same polymer particles used in Example 1: sodium polyacrylate, 2-ethylhexyl polyacrylate, polystyrene. The compositions had the following formulation (detergent composition 1).

| | |
|---|---|
| Polymer particles | 5.0% |
| Lauryl phosphate | 25.0 |
| Sodium hydroxide (48%) | 9.3 |
| 2-lauryl-N-carboxyethyl-N-hydroxyethyl imidazolinium betaine solution | 3.0 |
| Carboxyvinyl polymer | 0.5 |
| Polyethylene glycol | 3.5 |
| Sodium carbonate | 3.0 |
| P-oxybenzoic acid ester | 0.3 |
| Perfume | 0.3 |
| Purified water | Balance |
| Total | 100.0 |

Measurement of Detergency Improvement

The same procedure as in the measurement of detergency in Example 1 was carried out, except that detergent compositions of the above formulation and a detergent composition containing no polymer particles were used instead of polymer particle suspensions in 5% sodium chloride aqueous solution of Example 1. The detergency improvement was determined by the following formula, $$W = \frac{w - w_0}{100 - w_0} \times 100(\%)$$

wherein W is the detergency improvement, w is the detergency of the detergent composition containing polymer particles, and $w_0$ is the detergency of the composition containing no polymer particles.

Measurement of Anthema

The sample detergent compositions were applied 14 times to a specified site of the underarm using a teflon rod once in the morning and once in the evening. After that, the gloss or exfoliation of the skin was observed by the naked eye. The results of the observations were rated as follows. The mean value of the ratings obtained by the test using 10 subjects was taken as the degree of anthema.

| | |
|---|---|
| No change in the skin glossiness: | 0 |
| Exfoliation is slight: | 1 |
| Exfoliation is medium | 2 |
| Exfoliation is heavy | 3 |

TABLE 2

| Polymer Particles | Detergency Improvement (%) | Degree of Anthems |
|---|---|---|
| Example 1 | 50 | 0.1 |
| Example 2 | 38 | 0.1 |
| Polystyrene | 67 | 1.2 |

EXAMPLE 3

Sodium polyacrylate (3% cross-linked using ethylene glycol diglycidyl ether) polymer beads of various particle sizes listed in Table 3 were prepared. All polymer bead samples had a modulus of elasticity of $6.0\times10^4$ dyne/cm$^2$. Detergent compositions were prepared by the addition of the polymer beads according to the following formulation (detergent composition 2). The compositions were subjected to determination of the detergency improvement according to the following procedures. In addition, the feelings on use of the detergent compositions containing polymer beads were evaluated by the face-cleansing test described below.

| | |
|---|---|
| Polymer particles | 5.0% |
| Monolauroyl phosphate | 10.0 |
| Triethanolamine | 12.6 |
| Purified water | Balance |
| Total | 100.0 |

Measurement of Detergency Improvement

A synthetic sebum comprising 2% by weight of carbon black was applied to a specified site of the underarm. After drying for 1 hour, dirt on the skin surface was wiped off leaving the dirt in the skin creases. The skin was washed with sample detergent compositions containing polymer beads and a detergent composition of the above formulation without polymer beads. After washing, photographs of the treated site were taken and the photographs were subjected to image analysis to determine the amount of remaining sebum. The detergency was determined as the percentage of the measured sebum amount after washing to the sebum amount before washing. Detergency improvement was calculated from this value and the detergency improvement formula given in Example 2.

Evaluation of Feeling Upon Use

Massaging capacity and feeling upon use was evaluated by 10 panelists when 1 ml of the sample and comparative detergent compositions were used for face washing. The results of the evaluation were rated as follows:

AAA: Excellent

BBB: Good

CCC: Normal

DDD: Bad (inconsistency and irritation were felt)

The results are given in Table 3.

TABLE 3

| Polymer particle diameter before expansion (μm) | Polymer particle diameter after expansion (μm) | Rate of expansion | Detergency improvement (%) | Washing evaluation |
|---|---|---|---|---|
| 330 | 690 | 2.1 | 10 | DDD |
| 163 | 339 | 2.1 | 52 | BBB |
| 127 | 264 | 2.1 | 83 | BBB |
| 90 | 187 | 2.1 | 75 | AAA |
| 18 | 38 | .2.1 | 32 | BBB |

EXAMPLE 4

A soap of the following composition was prepared.

| | |
|---|---|
| Beads of Synthetic Example 1 | 5.0% |
| Sodium salts of coconut oil and tallow fatty acid | 82.0 |
| Dibutylhydroxytoluene | 0.1 |
| Cetanol | 0.5 |
| Perfume | Small amount |
| Colorant | Small amount |
| Purified water | Balance |
| Total | 100.0 |

EXAMPLE 5

A face cleansing foam of the following composition was prepared.

| | |
|---|---|
| Beads of Synthetic Example 1 | 3.0% |
| Potassium laurate | 40.0 |
| Glycerol | 8.0 |
| Propylene glycol | 3.0 |
| Sodium benzoate | 0.1 |
| Perfume | Small amount |
| Purified water | Balance |
| Total | 100.0 |

EXAMPLE 6

A body shampoo of the following composition was prepared.

| | |
|---|---|
| Beads of Synthetic Example 1 | 5.0% |
| Triethanolamine monolaurate | 45.0 |
| Ethanol | 10.0 |
| Propylene glycol | 10.0 |
| Perfume | Small amount |
| Purified water | Balance |
| Total | 100.0 |

All detergent compositions prepared in Examples 4–6 had both excellent feeling upon use and superior detergency.

EXAMPLE 7

A detergent composition 3 containing a germicide was prepared according to the following formulation. The germicidal capacity of the composition was evaluated according the following method. The results are given in Table 4.

| | |
|---|---|
| Beads of Synthetic Example 1 | 0% or 5.0% |
| Benzalkonium chloride | 0.2–1.0 |
| Potassium laurate | 10.0 |
| Purified water | Balance |
| Total | 100.0 |

Method of Evaluating Germicidal Effect

Five (5) ml of sterilized water was applied to the hands of 5 healthy subjects who had not washed hands for 6 hours. After rubbing the both hands each other to thoroughly apply the sterilized water, the hands were pressed over a 15 diameter petri dish containing a normal agar medium.

Then, 5 ml of a detergent composition 3 was applied to the hands of the subjects. After rubbing for 1 minutes, the both hands were washed with city water for 30 seconds. The hands were pressed over a 15 diameter petri dish containing a normal agar medium. This procedure was performed on the preparations containing different amounts of benzalkonium chloride given in Table 4.

After incubating the petri dishes for 3 days at 27° C., bacterial colonies which were produced were counted. The results obtained by 5 subjects on each preparation was averaged. The bacterium removing effects (%) were determined by the following formula.

$$\text{Bacterium Removing Effect} = \left[1 - \frac{\text{Number of Colonies after Sterilization}}{\text{Number of Colonies before Sterilization}}\right] \times 100\%$$

The results were shown in Table 4.

TABLE 4

| | Polymer Particles (Beads of Synthetic Example 1) | Benzalkonium Chloride | Germicidal Effect (%) |
|---|---|---|---|
| Preparation 1 | 5 | 0.2 | 87.3 |
| Preparation 2 | 5 | 0.5 | 99.8 |
| Preparation 3 | 5 | 1.0 | 99.0 |
| Comparative Preparation 1 | 0 | 0.2 | 35.0 |
| Comparative Preparation 2 | 0 | 0.5 | 65.0 |
| Comparative Preparation 3 | 0 | 1.0 | 74.0 |

Obviously, numerous modifications and variations of the present invention are possible in light of the above teachings. It is therefore to be understood that within the scope of the appended claims, the invention may be practiced otherwise than as specifically described herein.

What is claimed is:

1. A detergent composition comprising:

(A) from 0.1 to 30% by weight of the composition of polymer particles selected from the group consisting of carrageenan, gelatin, agar, tragacanth gum, viscose, methylcellulose, ethylcellulose, hydroxyethylcellulose, carboxymethylcellulose, polyvinyl alcohol; cross-linked homopolymers or copolymers of two or more monomers selected from acrylic acid or methacrylic acid (hereinafter collectively referred to as (meth-)acrylic acid), sodium or ammonium (meth)acrylic acid salts, N-substituted (meth)acrylic amides, 2-(meth-)acryloylethanesulfonic acid or salts thereof, styrenesulfonic acid or salts thereof, 2-hydroxyethyl (meth-)acrylate, N-vinylpyrrolidone, vinyl methyl ether, polyethylene oxide (meth)acrylic acid esters, $C_1$–$C_{16}$ alkyl (meth)acrylates, $C_1$–$C_{16}$ alkyl (meth)acrylates in which said $C_1$–$C_{16}$ alkyl is substituted with an ethoxy group, a cyano group or a phenyl group, fatty acid vinyl esters, (meth)acrylonitrile and vinyl chloride; saponified, cross-linked copolymers of vinyl acetate-methyl acrylate, vinyl acetate-monomethyl maleate and isobutylene-maleic anhydride; hydrolyzates of polysaccharide-acrylic acid or starch-acrylonitrile graft polymers; and silicone rubber; said polymer particles having an average particle size of from 50 to 500 μm and a modulus of elasticity of from $1\times10^3$ to $5\times10^5$ dyne/cm$^2$ as measured in 5 wt. % aqueous sodium chloride solution; and (B) from 10 to 90% by weight of the composition of a surface active agent, wherein the total of the weight percentages of components (A) and (B) are less than 100%, and the balance of the composition comprises purified water.

2. The composition of claim 1, wherein said polymer particles are cross-linked copolymers containing at least 50% by weight of salts or esters of poly(meth)acrylic acid.

3. The detergent composition of claim 1, wherein said composition comprises from 0.2 to 1.0% by weight of the composition of a germicide.

4. The detergent composition of claim 1, wherein said polymer particles have a modulus of elasticity of from $1\times10^4$ to $1\times10^5$ dyne/cm$^2$ as measured in 5 wt. % aqueous sodium chloride solution.

5. The detergent composition of claim 1, wherein said polymer particles have an average particle size of from 100 to 300 μm, as measured in 5 wt. % aqueous sodium chloride solution.

6. The detergent composition of claim 1, wherein said surface active agent is present in from 60 to 90% by weight of the composition.

7. The detergent composition of claim 1, wherein said surface active agent is present in from 40 to 70% by weight of the composition.

8. The detergent composition of claim 1, wherein said surface active agent is present in from 10 to 50% by weight of the composition.

9. The detergent composition of claim 1, wherein purified water is present in from 12.4 to 84.8% by weight of the composition.

* * * * *